US005663613A

United States Patent [19]

Yamashita et al.

[11] Patent Number: 5,663,613

[45] Date of Patent: Sep. 2, 1997

[54] LIGHTING CIRCUIT FOR DISCHARGE LAMP

[75] Inventors: Masayasu Yamashita; Atsushi Toda, both of Shimizu, Japan

[73] Assignee: Koito Manufacturing Co., Ltd., Tokyo, Japan

[21] Appl. No.: 648,518

[22] Filed: May 13, 1996

[30] Foreign Application Priority Data

May 12, 1995 [JP] Japan ..... 7-137426

[51] Int. Cl.[6] ..... G05F 1/00

[52] U.S. Cl. ..... 315/308; 315/307; 315/291; 315/82; 315/77; 315/DIG. 7; 315/225

[58] Field of Search ..... 315/307, 308, 315/291, 224, 225, 209 R, 127, 77, 80, 82, DIG. 7

[56] References Cited

U.S. PATENT DOCUMENTS

| | | | |
|---|---|---|---|
| 4,240,009 | 12/1980 | Paul | 315/224 |
| 4,724,360 | 2/1988 | Luursema | 315/244 |
| 4,727,290 | 2/1988 | Smith et al. | 315/82 |
| 5,068,570 | 11/1991 | Oda et al. | 315/128 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,151,634 | 9/1992 | Nepote et al. | 315/307 |
| 5,198,728 | 3/1993 | Bernitz et al. | 315/307 |
| 5,212,428 | 5/1993 | Sasaki et al. | 315/308 |
| 5,268,617 | 12/1993 | Daub et al. | 315/308 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |
| 5,514,935 | 5/1996 | Oda et al. | 315/209 |

FOREIGN PATENT DOCUMENTS

| | | |
|---|---|---|
| C23445817 | 12/1988 | Germany . |
| A14134537 | 4/1992 | Germany . |
| A14136486 | 5/1993 | Germany . |
| A14322139 | 1/1994 | Germany . |
| C24017415 | 4/1994 | Germany . |
| C24109325 | 4/1994 | Germany . |

*Primary Examiner*—Robert Pascal
*Assistant Examiner*—Haissa Philogene
*Attorney, Agent, or Firm*—Sughrue, Mion, Zinn, Macpeak & Seas

[57] ABSTRACT

A lighting circuit supplies an input voltage from a battery to a discharge lamp after the input voltage has been sent via a DC power supply section to a DC-AC converter. This lighting circuit comprises a lighting detector for detecting if the discharge lamp is lighted, an input-voltage monitor circuit for detecting the input voltage to the DC power supply section and checking if the input voltage lies within an allowable range, and a stable power supply circuit and a switch section for supplying power to the discharge lamp or inhibiting the power supply thereto in accordance with a signal from the input-voltage monitor circuit. The input-voltage monitor circuit performs variable control on a reference value to be compared with the input voltage, in accordance with a signal from the lighting detector.

20 Claims, 10 Drawing Sheets

1
2
3
3'
4
4'
5
B
6
DC POWER SUPPLY SECTION
7
Vcc
DC-AC CONVERTER
8
IGNITER CIRCUIT
9
9'
10
11
VOLTAGE/CURRENT DETECTOR
12
VS
IS
13
CONTROL CIRCUIT
14
LIGHTING DETECTOR
15
Vcc
Vcc
27
27a
27b
INPUT-VOLTAGE COMPARING SECTION
THRESHOLD CHANGING SECTION
28
STABLE POWER SUPPLY
SWITCH SECTION
28a

S(14)
40
41
42
43
44
45
46
47
48
49
50
51
51'
52
53
27
27a
27b
29
30
30'
31
32
33
34
35
36
37
38
39
65
B
B
E1
E2
OUT(+)
OUT(-)

LIGHTING CIRCUIT FOR DISCHARGE LAMP

BACKGROUND OF THE INVENTION

1. Field of the Invention

The present invention relates to a novel lighting circuit for a discharge lamp, which cuts off power supply to the discharge lamp when the input voltage to a DC power supply section drops, and which performs such power control that even when the discharge lamp is turned off due to the dropping of the battery voltages, power is supplied to the discharge lamp to turn it on when there is a sign of the restoration of the dropped input voltage and does not over-respond to a variation in the input voltage to thereby avoid repeating the periodic status change. This lighting circuit can be adapted for a vehicular discharge lamp, for example.

2. Description of the Related Art

Recently, compact discharge lamps (e.g., metal halide lamps) are receiving greater attention as a light source to take the place of an incandescent lamp. To adapt a discharge lamp to the light source for a vehicular lamp, it is necessary to take some measures to protect the lighting circuit against a change in the input voltage.

This protective measure should be taken to prevent the lighting status of a discharge lamp from becoming unstable or to prevent the malfunction or the like of the lighting circuit in response to a variation in the input voltage. For example, there has been proposed a lighting circuit which is equipped with a circuit for detecting the input voltage, causes a power cutoff circuit to inhibit power supply to a discharge lamp when the input voltage drops lower than a threshold value and maintains the power cutoff state unless the ignition switch is switched on again.

This proposed circuit however keeps cutting off power supply to the discharge lamp even if the input voltage, once dropped below the threshold value, has returned to a level higher than the threshold value. In other words, even though the input voltage is restored to the level enough to keep the lighting of a discharge lamp, this circuit cannot ignite the discharge lamp unless a user switches on the ignition switch again.

When the input voltage is restored to or higher than the threshold value, the inhibition of power supply to the discharge lamp should be released to turn on the discharge lamp.

It is however necessary to consider the voltage drop of the input voltage to the lighting circuit caused by the wiring or the like. When the wires to connect the power supply to the lighting circuit are long as in the case of a lighting circuit for a discharge lamp as a vehicular lamp, for example, the voltage drop becomes larger accordingly. If the threshold value is set to a constant value regardless of the status of the discharge lamp, the power supply to the discharge lamp and the power cutoff may be repeated in short cycles due to a change in the input voltage.

FIG. 10 is a conceptual diagram for explaining how such repetition occurs, showing the input voltage (indicated by "B") on the horizontal scale. FIG. 10 illustrates the operational statuses on the lighting circuit separated into four modes by a solid line a passing a point Bs or the threshold value and perpendicular to the horizontal scale and a broken line b parallel to the horizontal scale.

The modes (1) and (2) on the left-hand side of the solid line a are distinguished from the modes (3) and (4) on the right-hand side of the solid line a, depending on if the input voltage B is greater than the threshold value, while the modes (1) and (4) above the broken line b are distinguished from the modes (2) and (3) below the broken line b depending on whether or not the discharge lamp is turned on.

When the input voltage B drops during the lighting of the discharge lamp shown by the mode (4), the operational state enters the mode (1). When the discharge lamp is turned off then, the operational state enters the mode (2). The mode (3) is the state where the discharge lamp is turned off, causing the current flowing into the lighting circuit to become zero, and the input voltage B is restored. When the discharge lamp is lighted thereafter, the operational state proceeds to the mode (4).

A variation in the input voltage B caused by the voltage drop may cause a short cycle of the mode change from the mode (4), to the mode (1), to the mode (2), to the mode (3) and back to the mode (4) in the case where the lighting of the discharge lamp fails due to the reduced input voltage B or where the ignition swatch is activated again to turn on the discharge lamp when the input voltage B has dropped. Such a phenomenon, a kind of chattering, would interfere with the control stability.

SUMMARY OF THE INVENTION

Accordingly, it is an objective of the present invention to provide a lighting circuit for a discharge lamp that supplies power to the discharge lamp, which has been turned off due to the dropping of the input voltage, to turn it on again, when there is a sign of the restoration of the dropped input voltage and does not over-respond to a variation in the input voltage to thereby avoid repeating the periodic status change.

To achieve this object, according to the present invention, there is provided a lighting circuit for a discharge lamp, which has a DC power supply section to be supplied with a voltage from a DC power supply and supplies an output voltage, based on the output voltage of the DC power supply section, to the discharge lamp, and which comprises:

(1) lighting detection means for detecting if the discharge lamp is lighted;

(2) input-voltage monitor means for detecting an input-voltage to the DC power supply section and checking if the input voltage lies within an allowable range, the input-voltage monitor means having input-voltage comparing means for detecting the input voltage to the DC power supply section and comparing the input voltage with a first threshold value or a second threshold value, and threshold changing means for changing the first or second threshold value; and (3) power-supply allowing/inhibiting means for allowing or inhibiting power supply to the discharge lamp in accordance with a signal from the input-voltage monitor means, whereby when the input voltage to the DC power supply section is less than the first threshold value at a time the input-voltage monitor means receives a signal indicative of the light-OFF state of the discharge lamp from the lighting detection means, the input-voltage monitor means sends a signal to the power-supply allowing/inhibiting means to cut off power supply to the discharge lamp and when the input voltage to the DC power supply section exceeds the second threshold value, the input-voltage monitor means sends a signal to the power-supply allowing/inhibiting means to supply power to the discharge lamp, and whereby when the signal from the lighting detection means indicates the light-OFF state of the discharge lamp, the threshold changing means sets the first threshold value in the input-voltage monitor means smaller than the first threshold value in the light-ON state of the discharge lamp and/or sets the second threshold value in the input-voltage monitor means smaller than the second threshold value in the light-ON state of the discharge lamp.

According to the lighting circuit of this invention, the first threshold value and/or the second threshold value in the light-OFF state of a discharge lamp is set smaller than the first threshold value and/or the second threshold value in the light-ON state of the discharge lamp, so that when the input voltage is restored after the discharge lamp has been turned off by the dropping of the input voltage, power supply to the discharge lamp is unlikely to be cut off or power supply to the discharge lamp becomes easier, thus allowing the discharge lamp to be turned on again.

In the case where the input voltage B rises and the mode (3) is shifted to the mode (4) in FIG. 10, even when the lighting circuit is activated to reduce the input voltage, the threshold value used to determine the power supply to the discharge lamp or the restoration of the input voltage is also reduced, so that power supply to the discharge lamp is apt to be maintained.

BRIEF DESCRIPTION OF THE DRAWINGS

The feature of the present invention that are believed to be novel are set forth with particularity in the appended claims. The invention, together objects and advantages thereof, may best be understood by reference to the following description of the presently preferred embodiments together with the accompanying drawings.

FIGS. 1 through 7 illustrate a lighting circuit according to the first embodiment of the present invention.

FIG. 1 is a block diagram showing the circuit structure of the lighting circuit according to the first embodiment;

FIG. 4 is a circuit diagram exemplifying the structure of an input-voltage monitor circuit;

FIG. 5 is a circuit diagram exemplifying the structure of a stable power supply circuit;

FIG. 6 is a time chart for explaining the operation of the lighting circuit; and FIG. 7 is a time chart for explaining another operation different from that shown in FIG. 6.

FIGS. 8 and 9 illustrate a lighting circuit according to the second embodiment of this invention.

FIG. 8 is a circuit diagram showing the structure of an input-voltage monitor circuit.

DETAILED DESCRIPTION OF THE PREFERRED EMBODIMENTS

Lighting circuits for a discharge lamp according to preferred embodiments of the present invention will be now described in detail with reference to the accompanying drawings. In the illustrated embodiments, this invention is adapted for a lighting circuit of a square-wave lighting system.

FIGS. 1 through 7 illustrate a lighting circuit according to the first embodiment of this invention.

Figure 1:
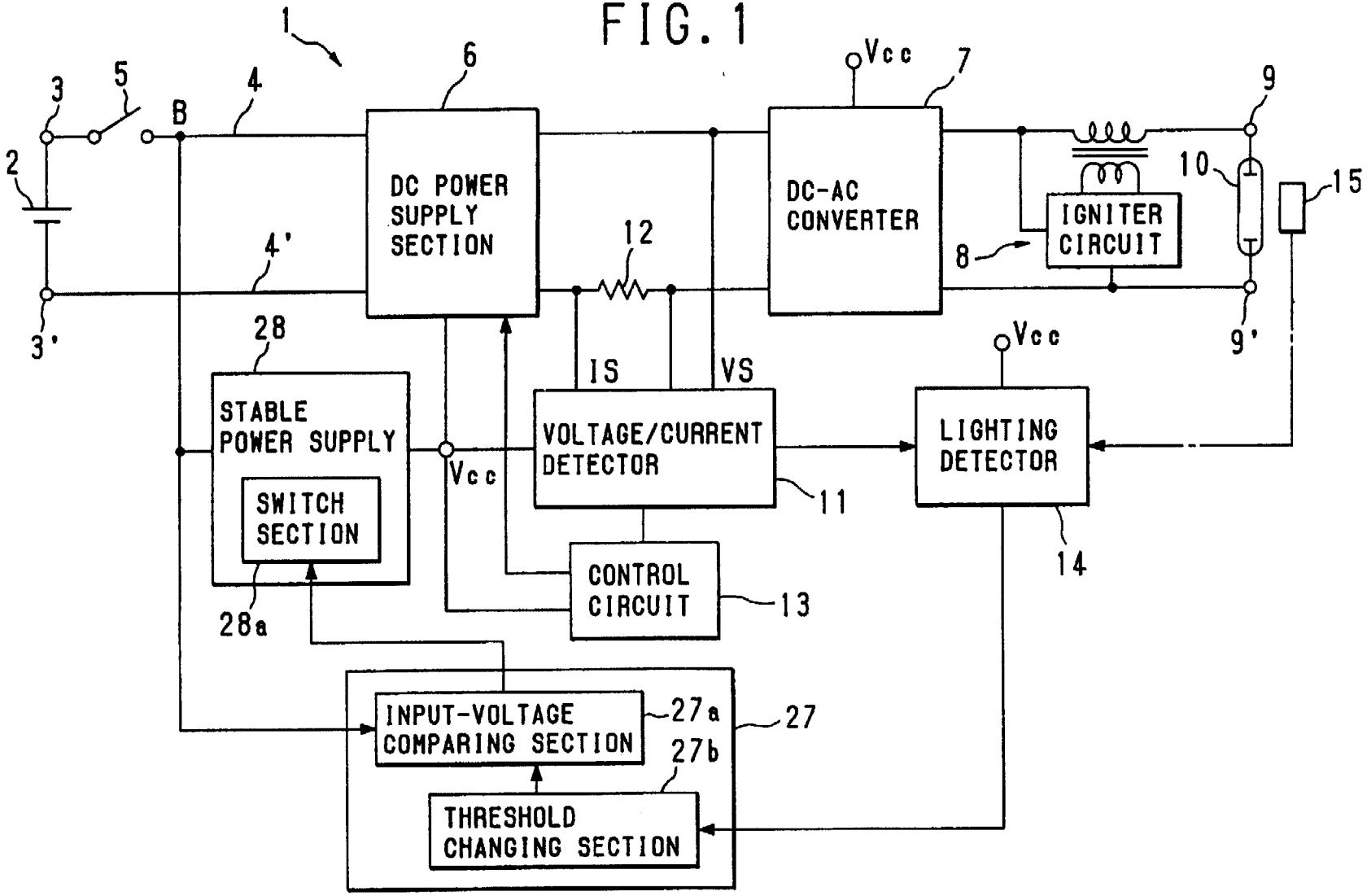

FIG. 1 shows the outline of a lighting circuit 1. The lighting circuit 1 has a battery 2, connected between DC voltage input terminals 3 and 3'. There are two DC power lines 4 and 4', and a lighting switch 5 is provided on the positive DC power line 4.

The voltage from the battery 2 is input to a DC power supply section 6. In this embodiment, the DC power supply section 6 serves as a DC booster/step-down circuit which boosts and/or reduces the input voltage (i.e., the voltage, B, acquired by subtracting a voltage drop, caused by the wiring or the like, from the battery voltage). The DC power supply section 6 is controlled by a control circuit which will be discussed shortly after.

A DC-AC converter 7, provided at the subsequent stage of the DC power supply section 6, converts the output voltage of the DC power supply section to a square-wave voltage.

An igniter circuit 8 is provided at the subsequent stage of the DC/AC converter 7. A discharge lamp 10 is connected between AC output terminals 9 and 9' of the igniter circuit 8. It is to be noted that a metal halide lamp having the rated power of, for example, 35 W is used as the discharge lamp 10 .

A voltage/current detector 11 serves to detect the output voltage and output current of the DC power supply section 6. More specifically, the voltage/current detector 11 receives not only the output voltage of the DC power supply section 6, but also receives a signal, which corresponds to the output current of the DC power supply section 6 converted into a voltage form by a current-detecting resistor 12. This current-detecting resistor 12 is provided on the ground line that connects the DC power supply section 6 to the DC-AC converter 7.

A control circuit 13 controls the output voltage of the DC power supply section 6. The control circuit 13 generates a control signal according to the signal from the voltage/current detector 11, and sends this control signal to the DC power supply section 6 to control the output voltage thereof. Accordingly, the control circuit 13 performs power control which matches with the status of the discharge lamp 10, thereby shortening the activation time and the re-activation time of the discharge lamp 10 and ensuring the steady lighting control of the discharge lamp 10 in a steady lighting mode.

A lighting detector 14 detects if the discharge lamp 10 is lighted. The methods of detecting the lighting state of the discharge lamp 10 include a method of monitoring a signal from the voltage/current detector 11, which is equivalent to the lamp voltage or the lamp current of the discharge lamp 10, or a method of directly detecting the light irradiated from the discharge lamp 10 by means of a photosensor 15.

Figure 2A:
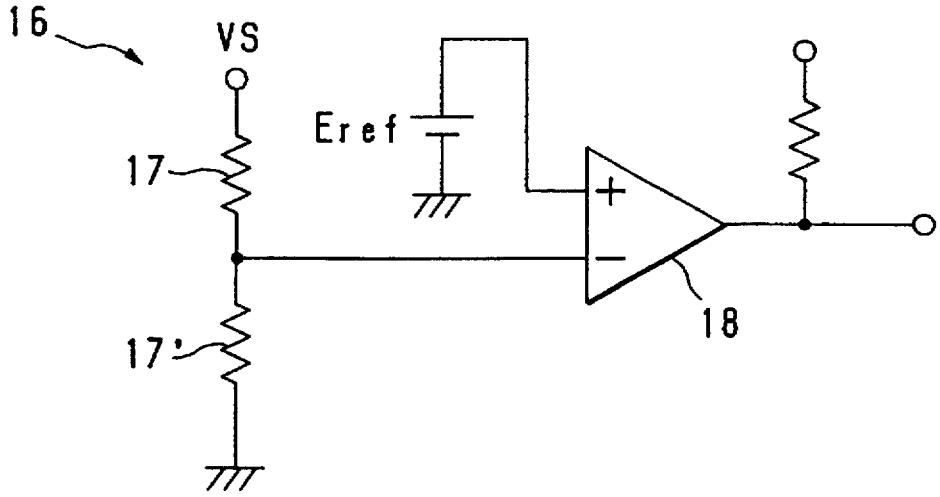
FIG. 2A shows the structure of one example of a lighting detector, which uses a voltage detection signal VS.

FIG. 2A exemplifies a circuit 16 which monitors a voltage detection signal (hereinafter indicated by "VS") from the voltage/current detector 11 to detect the light-ON state or the light-OFF state of the discharge lamp 10. The detection signal VS is voltage-divided by voltage-dividing resistors 17 and 17'. The resultant signal is sent to the negative input terminal of the comparator 18 to be compared with a reference voltage Eref which is supplied to the positive input terminal of the comparator 18. In other words, when the amplified level of the voltage-divided detection signal VS is lower than the reference voltage Eref, it is detected that the discharge lamp 10 has been lighted, and the comparator 18 outputs an B (High)-level signal.

Figure 2B:
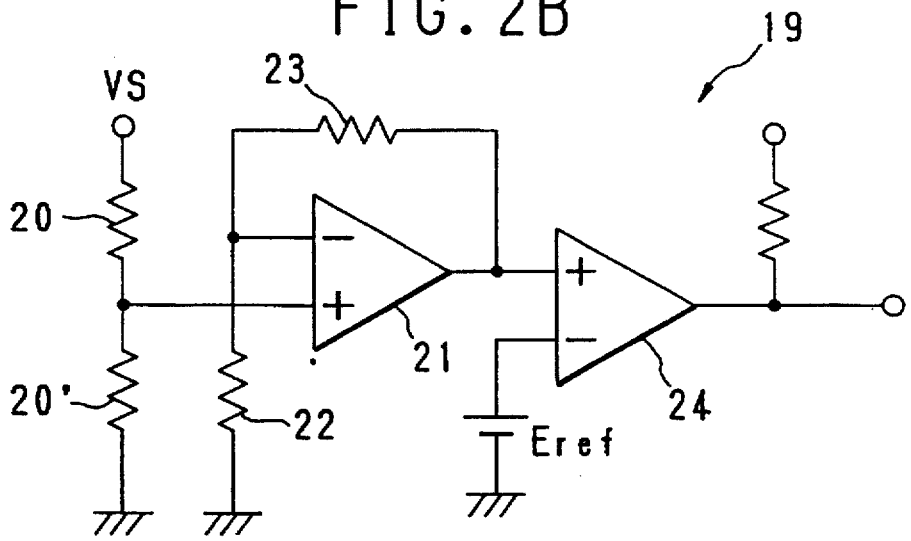
FIG. 2B shows the structure of another example of the lighting detector, which uses a current detection signal IS.

FIG. 2B shows a circuit 19 which monitors a current detection signal (hereinafter indicated by "IS") from the voltage/current detector 11 to detect the light-ON state or the light-OFF state of the discharge lamp 10. The detection signal IS is voltage-divided by voltage-dividing resistors 20 and 20'. The resultant signal is sent to the non-inverting input terminal of an operational amplifier 21 which constitutes a differential amplifier circuit. The inverting input terminal of the operational amplifier 21 is grounded via a resistor 22 and is connected via a feedback resistor 23 to the output terminal of this amplifier 21. The output of the operational amplifier 21 is sent to the positive input terminal of a comparator 24, located at the subsequent stage, to be compared with a reference voltage Eref which is supplied to the negative input terminal of the comparator 24. That is, when the voltage-divided level of the detection signal IS is higher than the reference voltage Eref, it is detected that the discharge lamp 10 has been lighted, and the comparator 24 outputs an H-level signal.

Figure 2C:
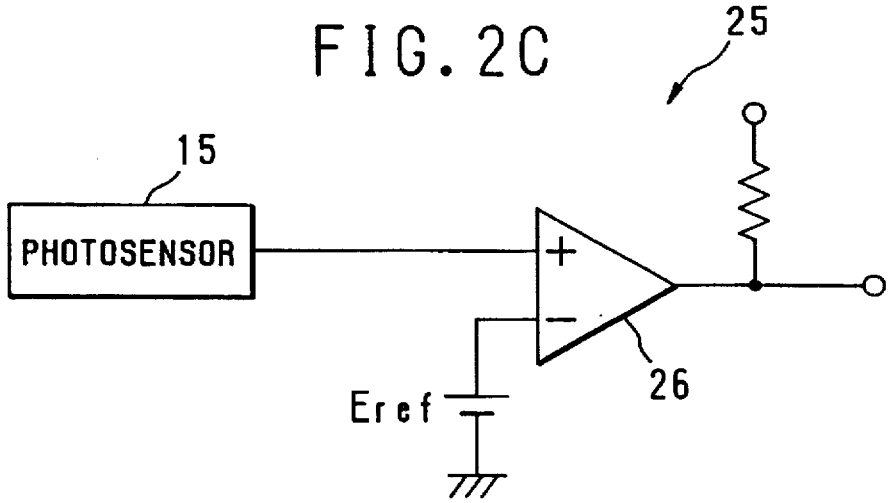
FIG. 2C shows the structure of a further example of the lighting detector, which uses a detection signal from a photosensor.

FIG. 2C shows a circuit 25 which monitors the output signal of the photosensor 15 to detect the light-ON state or the light-OFF state of the discharge lamp 10. The detection signal from the photosensor 15 is sent to the positive input terminal of a comparator 26 where it is compared with a reference voltage Eref supplied to the negative input terminal of the comparator 26. That is, when the voltage level of the detection signal is higher than the reference voltage Eref, it is detected that the discharge lamp 10 has been lighted, and the comparator 26 sends out an H-level signal.

As signals equivalent to the lamp voltage and lamp current of the discharge lamp 10 are input as power control signals to the control circuit 13 in the lighting circuit 1 in the examples illustrated in FIGS. 2A and 2B, those equivalent signals are also used to detect the light-ON state or light-OFF state of the discharge lamp, thus simplifying the overall circuit structure. However, it should be noted that the lamp voltage and lamp current of the discharge lamp 10 could be detected at the subsequent stage of the DC-AC converter 7.

An input-voltage monitor circuit 27 detects the input voltage and determines the level of the input voltage based on the threshold value which is variably controlled in accordance with the signal from the lighting detector 14.

The input-voltage monitor circuit 27 comprises an input-voltage comparing section **27*a* and a threshold changing section 27*b***.

The input voltage B branched from the power supply line 4 at the input stage of the DC power supply section 6 is sent to the input-voltage comparing section **27*a* to be compared with a predetermined threshold value. The threshold changing section 27*b* serves to alter the threshold value of the input-voltage comparing section 27*a* upon reception of the signal from the lighting detector 14 when the discharge lamp 10** is turned off by the dropped input voltage B.

FIG. 3 shows the comparison characteristics of the input-voltage comparing section **27*a* with the input voltage B shown on the horizontal scale and binary states (H and L) on the vertical scale. The input-voltage comparing section 27*a*** has a hysteresis characteristic.

Figure 3A:
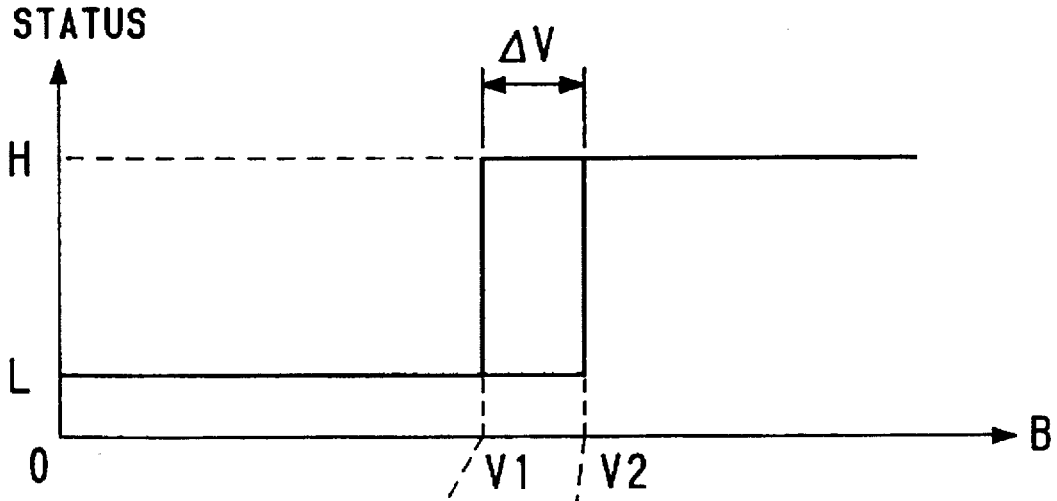
FIGS. 3A and 3B are graphs used to explain the hysteresis characteristics of a comparator.

FIG. 3A shows the comparison characteristic when the discharge lamp 10 is lighted; "V1" and "V2" (V1<V2) represent threshold values and "ΔV" represents the voltage difference (V2−V1) between both threshold values.

The input-voltage comparing section **27*a*** outputs an H-level signal when the input voltage B exceeds the threshold value V2 and outputs an L (Low)-level signal when the input voltage B becomes less than the threshold value V1.

Figure 3B:
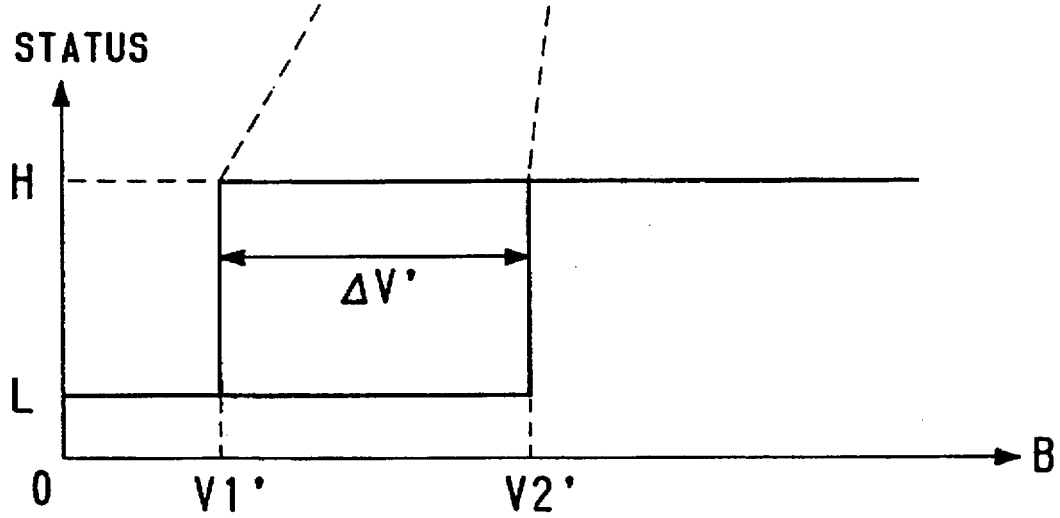

FIG. 3B shows the comparison characteristic when the discharge lamp 10 is in the OFF state; "V1'" and "V2'" (V1'<V2') represent threshold values and "ΔV'" represents the voltage difference (V2'−V1') between both threshold values. In this example, V1'<V1 and V2'<V2.

The input-voltage comparing section **27*a*** outputs an H-level signal when the input voltage B exceeds the threshold value V2' and outputs an L-level signal when the input voltage B becomes less than the threshold value V1'.

The threshold value in the input-voltage comparing section **27*a* is variably controlled by the threshold changing section 27*b* in accordance with the status of the discharge lamp 10 or the input voltage, and a binary signal output from the input-voltage comparing section 27*a* is sent to a stable power supply circuit 28 (see FIG. 1**).

Figure 4:
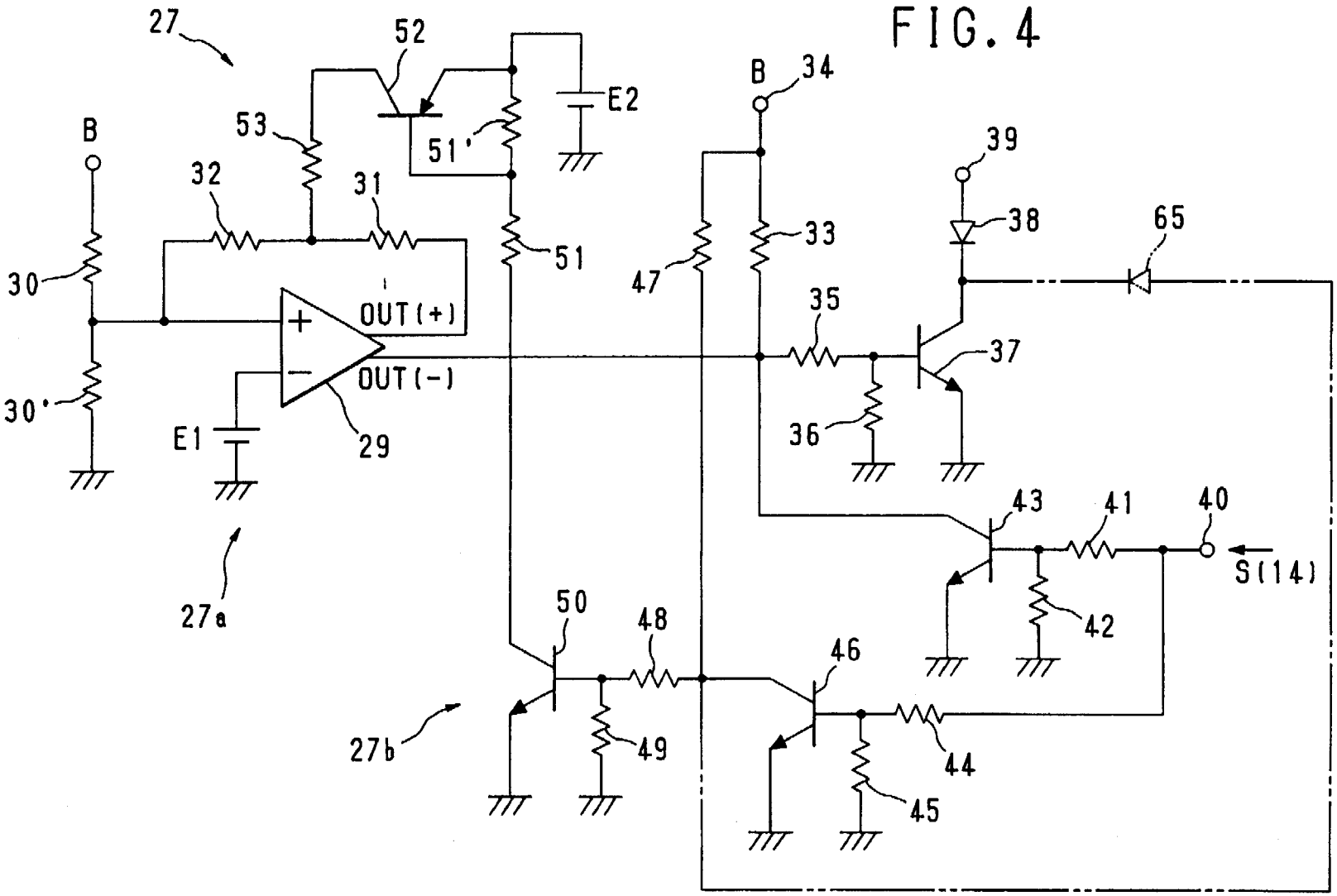

FIG. 4 exemplifies the structure of the input-voltage monitor circuit 27.

The input-voltage comparing section **27*a* is constituted using a comparator 29 whose positive input terminal is supplied with the input voltage B via voltage-dividing resistors 30 and 30' and whose negative input terminal is supplied with a predetermined reference voltage E1. The comparator 29 has two output terminals so as to be able to provide two outputs in the opposite phases. One of the output terminals (OUT(+)) is connected via resistors 31 and 32 to the positive input terminal of the comparator 29, while the other output terminal (OUT(−)) is connected to a terminal 34 (to which the input voltage B is supplied) via a resistor 33 and also to the base of an emitter-grounded NPN transistor 37 via resistors 35 and 36. The collector of the transistor 37 is connected via a diode 38 to a terminal 39 which is further connected to the stable power supply circuit 28** as will be discussed later.

After the signal from the lighting detector 14 is supplied to a terminal 40, it is branched to two ways, one sent to the base of an emitter-grounded NPN transistor 43 via resistors 41 and 42 and the other sent to the base of an emitter-grounded NPN transistor 46 via resistors 44 and 45. The collector of the transistor 43 is connected between the resistors 33 and 35, the collector of the transistor 46 is connected to the terminal 34 via a resistor 47 and to the base of an emitter-grounded NPN transistor 50 via resistors 48 and 49.

The collector of the transistor 50 is connected via resistors 51 and 51' to a constant power supply E2, with the resistor 51' being inserted between the base and emitter of a PNP transistor 52. The collector of the transistor 52 is connected between the resistors 31 and 32 via a resistor 53. The circuit portion from the terminal 40 to the transistors 43, 46, 50 and 52 and the peripheral circuits is equivalent to the threshold changing section **27*b*, which alters the threshold value of the comparator 29 in accordance with a change in the voltage value of the constant power supply E2 and a change in the resistance in the feedback path of the comparator 29, in response to the signal from the lighting detector 14**.

The stable power supply circuit 28 produces a predetermined voltage based on the input voltage B, and supplies the necessary supply voltage ("Vcc") and a reference voltage to the DC power supply section 6, the DC-AC converter 7, the voltage/current detector 11, the control circuit 13, the lighting detector 14, the input-voltage monitor circuit 27 and other circuits. The stable power supply circuit 28 is provided with a switch section **28*a* serving as power-supply allowing/inhibiting means to supply power to the discharge lamp 10** or cut off power thereto. The switch section 28a is controlled by the signal from the input-voltage monitor circuit 27. More specifically, the ON/OFF control of the switch section 28a is executed by the output signal of the input-voltage monitor circuit 27, according to the result of which the supply of power or inhibition of power to the individual sections of the lighting circuit 1 is performed to control the power supply/power cutoff to the discharge lamp 10.

Figure 5:
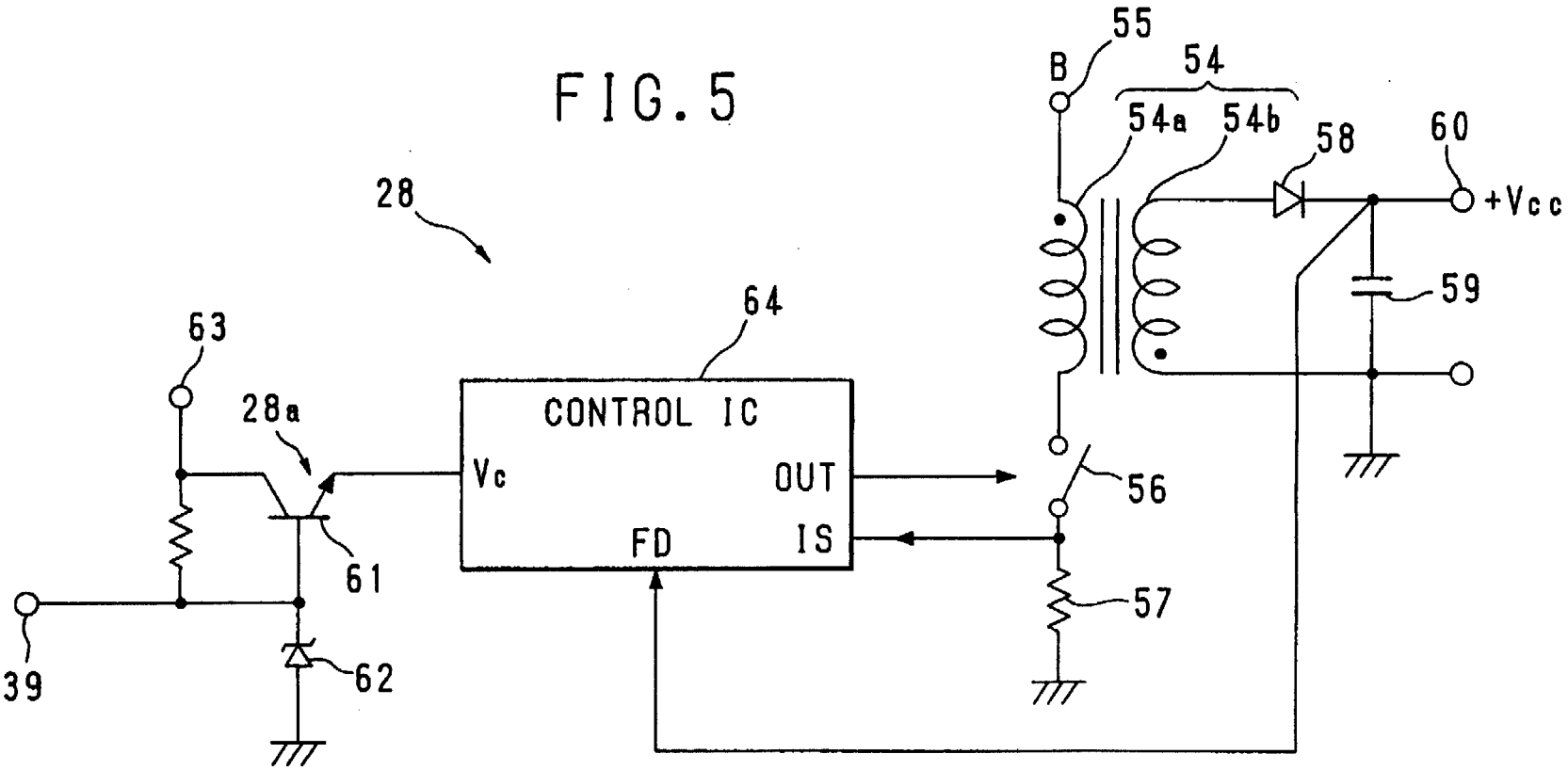

FIG. 5 exemplifies the structure of the stable power supply circuit 28 which takes the structure of a flyback transformer.

A transformer 54 has a primary winding 54a whose one end is connected to a terminal 55 that is supplied with the input voltage B, and whose other end is grounded via a semiconductor switch element 56 (indicated by the symbol of a switch in the diagram) and a resistor 57. The transformer 54 has a secondary winding 54b whose output is rectified and smoothed by a diode 58 and a capacitor 59 whose terminal voltage is acquired as Vcc from a terminal 60.

Although the switch section 28a may be a mechanical switch such as a relay contact, an NPN transistor 61 as a semiconductor switch element is used in this embodiment. The transistor 61 has its base connected to the output terminal 39 of the input-voltage monitor circuit 27 and grounded via a Zener diode 62. The collector of the transistor 61 is connected to a terminal 63, with the emitter connected to the power terminal (Vc) of a control IC 64.

The input voltage B is supplied to the terminal 63, so that the switching control of the transistor 61 is executed by the signal from the output terminal 39 of the input-voltage monitor circuit 27. That is, when an H-level signal is supplied to the output terminal 39, the transistor 61 is turned on, causing the control IC 64 to operate.

The control IC 64 is provided to send a signal to the semiconductor switch element 56 from its output terminal (OUT) to execute the switching control. The current detected through the resistor 57 is sent to the detection terminal (IS) of the control IC 64, and the terminal voltage of the capacitor 59 is fed back to the feedback terminal (FD) of the control IC 64.

Figure 6:
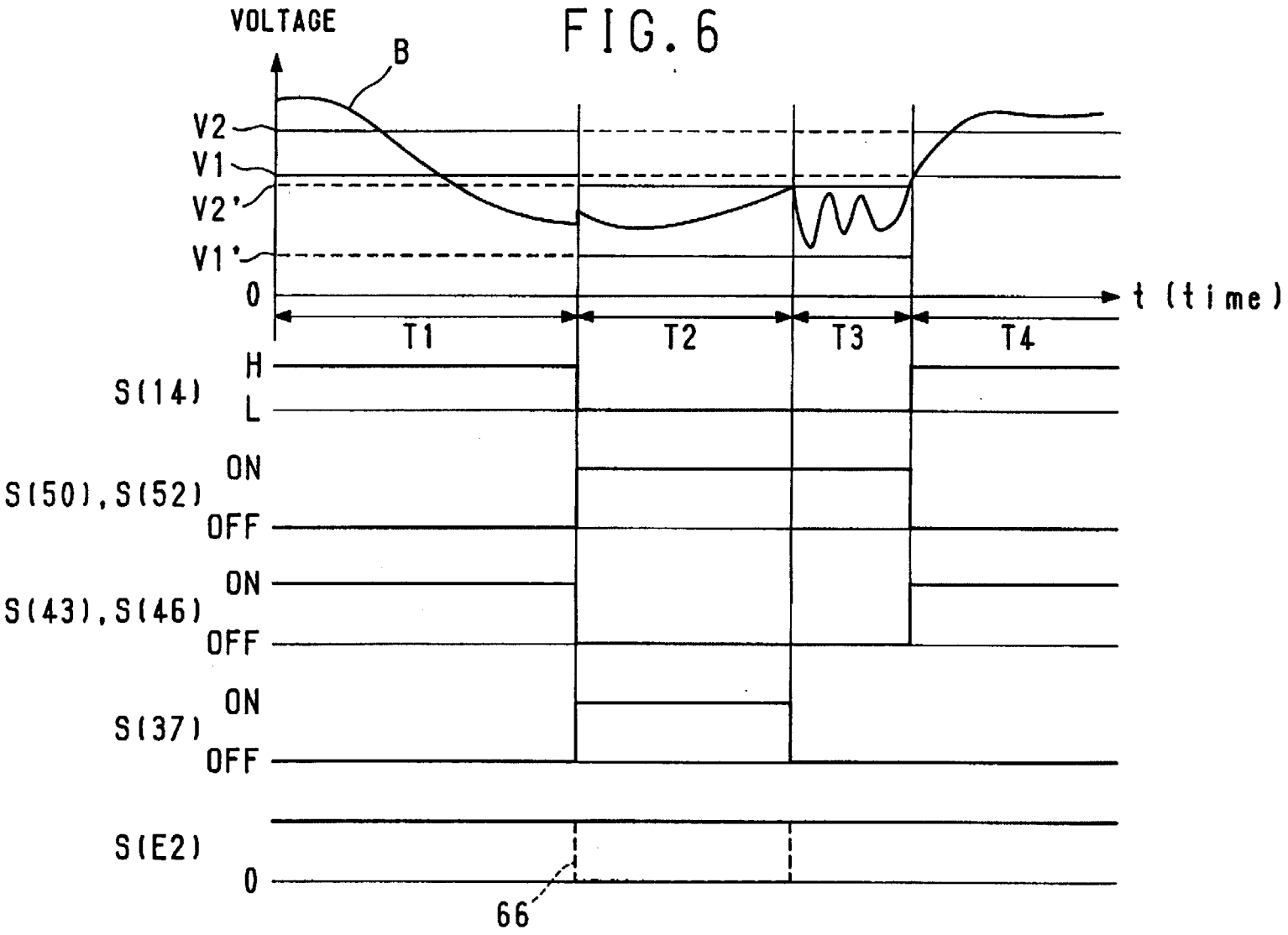

FIG. 6 presents a time chart illustrating a change in the input voltage B and a change in the threshold value at the top, and showing the statuses of the individual circuits below. In the diagram, "S(14)" indicates the output signal of the lighting detector 14, "S(43)" indicates the operational status of the transistor 43, "S(46)" indicates the operational status of the transistor 46, "S(50)" shows the operational status of the transistor 50, "S(52)" represents the /operational status of the transistor 52, "S(37)" indicates the operational status of the transistor 37, and "S(E2)" shows the voltage of the constant voltage supply E2. "T1" shows period in which the input voltage B has dropped during the lighting of the discharge lamp 10, "T2" indicates the period in which the input voltage B is rising after the discharge lamp 10 has been turned off, "T3" represents the period in which the activation of the discharge lamp 10 is performed during the light-OFF state of the discharge lamp 10, and "T4" shows the period in which the discharge lamp 10 is lighted and the input voltage B has recovered. "V1", "V2", "V1" and "V2" are the same as those discussed earlier.

In the period T1, the discharge lamp 10 is lighted and the output signal S(14) of the lighting detector 14 has a high (H) level, so that the transistors 43 and 46 are turned on while the transistors 50 and 52 are turned off. Accordingly, V1 and V2 are the threshold values of the comparator 29. As the transistor 37 is disabled by the transistor 43 regardless of the output signal of the comparator 29, the transistor 61 of the stable power supply circuit 28 is enabled, permitting power supply to the discharge lamp 10.

When the discharge lamp 10 is turned off in the period T2, the output signal S(14) of the lighting detector 14 goes low (L), disabling the transistors 43 and 46 and enabling the transistors 50 and 52. Because the input voltage B is less than V1 at the time of transition from the period T1 to the period T2, the H-level signal output from the output terminal OUT(−) of the comparator 29 enables the transistor 37. As a result, the transistor 61 of the stable power supply circuit 28 is turned off, thus inhibiting power supply to the discharge lamp. As the transistor 52 is enabled, the threshold values of the comparator 29 drop to V1' and V2'.

In the subsequent period T3, when the input voltage B rises above V2', the output signal to be sent to the transistor 37 from the output terminal OUT(−) of the comparator 29 goes low, disabling the transistor 37. As a result, the transistor 61 of the stable power supply circuit 28 is turned on to restart power supply to the discharge lamp 10. In other words, the input voltage B varies due to the influence of %he charging current of the capacitor in the lighting circuit 1, the activation current of the internal circuits (like the DC power supply section 6) or the like during the period from the transition of the transistor 37 to the OFF state to the lighting of the discharge lamp 10 caused by the application of the activation pulse from the igniter circuit 8 to the discharge lamp 10. As the transistor 52 stays enabled, the threshold values of the comparator 29 remain unchanged from V1' and V2'. Unless the input voltage B becomes less than V1', the output signal from the output terminal OUT(−) of the comparator 29 stays low and the transistor 37 remains disabled.

When the discharge lamp 10 is lighted at the start of the period T4, the circuit state is returned to that in the case of the period T1. The H-level signal from the lighting detector 14 turns on the transistors 43 and 46 and turns off the transistors 50 and 52, so that the threshold values of the comparator 29 return to V1 and V2. There is some length of time at the beginning of the period T4 where the input voltage B is less than V1, during which the transistor 37 is forcibly disabled by the transistor 43.

As described above, power supply control is executed in such a way that the threshold values of the input-voltage comparing section 27a are dropped to V1' and V2' in the periods T2 and T3 and power supply to the discharge lamp 10 is restarted when there is a sign of recovery of the input voltage B and B becomes greater than V2' (B>V2'), thus helping reactivating the discharge lamp 10. If the threshold values of the input-voltage comparing section 27a are always set to constant values, power supply to the discharge lamp 10 is stopped again when the input voltage B drops lower than the minimum threshold value at the time the reactivation of the discharge lamp 10 is attempted. If such occurs, all the efforts to reactivate the discharge lamp 10 by the recovered input voltage B would come to nothing, so that the input-voltage comparing section 27a would over-respond to a variation in the input voltage B. To avoid such an inconvenience, the threshold values are dropped to V1' from V1 and to V2' from V2 when the discharge lamp 10 is deactivated by the reduced input voltage B according to this embodiment. Under the situation where the input voltage B appears to be recovered, therefore, the inhibition of power supply to the discharge lamp 10 becomes unlikely to occur and the discharge lamp 10 is likely to be lighted.

The lower the threshold values V1 and V1' become, the less likely the inhibition of power supply to the discharge lamp 10 is caused by a reduction in the input voltage B. The lower the threshold values V2 and V2' become, the easier it gets to restart the power supply to the discharge lamp 10 in response to an increase in the input voltage B. In this respect, the threshold value V1 and V1' can be said to be cutoff voltages with respect to the input voltage B, and the threshold values V2 and V2' can be said to be return voltages with respect to the input voltage B.

The illustrated input-voltage monitor circuit 27 is designed to reduce the threshold values of the comparator 29 in the period T2. The input-voltage monitor circuit 27 may however be modified to include an additional diode 65 whose cathode is connected to the collector of the transistor 37 and whose anode is connected to the collector of the transistor 46, as shown by the two-dot chain line in FIG. 4. This modification allows the threshold values of the comparator 29 in the period T2 to be the same as the threshold values V1 and V2 in the period T1.

Figure 7:
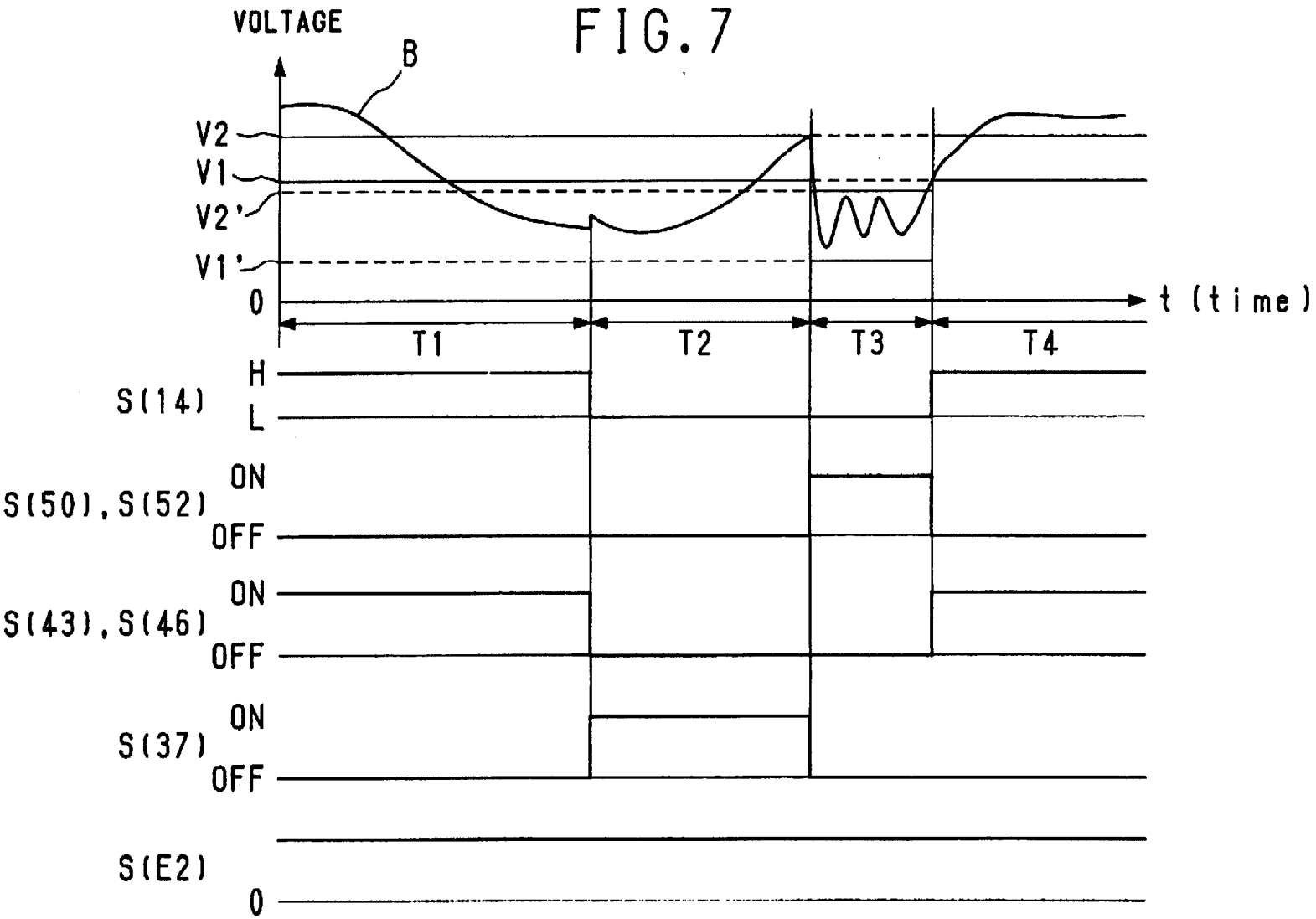

FIG. 7 presents a time chart illustrating how the input voltage B varies and the statuses of the individual circuits at respective timings. In the period T1 where the input voltage B is dropped during the lighting of the discharge lamp 10, the L-level signal sent from the output terminal OUT(−) of the comparator 29 disables the transistor 37, and the B-level output signal of the lighting detector 14 enables the transistors 43 and 46 and disables the transistors 50 and 52. As a result, the threshold values of the input-voltage comparing section 27*a* become V1 and V2.

When the discharge lamp 10 is turned off due to the reduction in the input voltage B in the period T2, the H-level signal sent out from the output terminal OUT(−) of the comparator 29 turns on the transistor 37, rendering the diode 65 conductive, so that the transistors 50 and 52 are forcibly turned off. Therefore, the threshold values of the comparator 29 stay unchanged from V1 and V2 in the period T1.

In the subsequent period T3, when the input voltage B rises above V2, the output signal to be sent to the transistor 37 from the output terminal OUT(−) of the comparator 29 goes low, disabling the transistor 37. As a result, the transistor 61 of the stable power supply circuit 28 is turned on to restart power supply to the discharge lamp 10. In other words, the input voltage B varies due to the influence of the charging current of the capacitor in the lighting circuit 1, the activation current of the internal circuits (like the DC power supply section 6) or the like during the period from the transition of the transistor 37 to the OFF state to the lighting of the discharge lamp 10 caused by the application of the activation pulse from the igniter circuit 8 to the discharge lamp 10. As the transistor 37 is turned off, the diode 65 is rendered non-conductive and the transistors 50 and 52 are turned on, causing the threshold values of the comparator 29 to drop to V1' and V2'. Unless the input voltage B becomes less than V1', the signal which is sent to the transistor 37 from the output terminal OUT(−) of the comparator 29 has an L level and the transistor 37 remains disabled.

When the discharge lamp 10 is lighted at the start of the period T4, the circuit state is returned to that in the case of the period T1. The H-level signal from the lighting detector 14 turns on the transistors 43 and 46 and turns off the transistors 50 and 52, so that the threshold values of the comparator 29 return to V1 and V2.

As explained above, it is possible to secure the input voltage B at the reactivation of the discharge lamp 10 to ensure the reactivation of the discharge lamp 10 by setting the threshold values of the comparator 29 in the period T2 same as the threshold values V1 and V2 in the period T1.

The above-described circuit operation can be easily accomplished by, instead of additionally providing the diode 65, designing the constant voltage supply E2 in such a way as to produce a predetermined voltage only when the stable power supply circuit 28 is in operation.

In this case, therefore, the transistor 37 is turned on to disable the transistor 61, causing the stable power supply circuit 28 to stop operating, in the period T2, so that the voltage value of the constant voltage supply E2 becomes zero as indicated by a broken line 66 in the part S(E2) in FIG. 6. Even if the transistors 50 and 52 are currently enabled, the threshold values of the comparator 29 remain as V1 and V2. In the period T3, the stable power supply circuit 28 causes the voltage of the constant voltage supply E2 to return to the same voltage as that in the period T1, so that the enabled transistors 50 and 52 set the threshold values of the comparator 29 to V1' and V2'.

Figure 8:
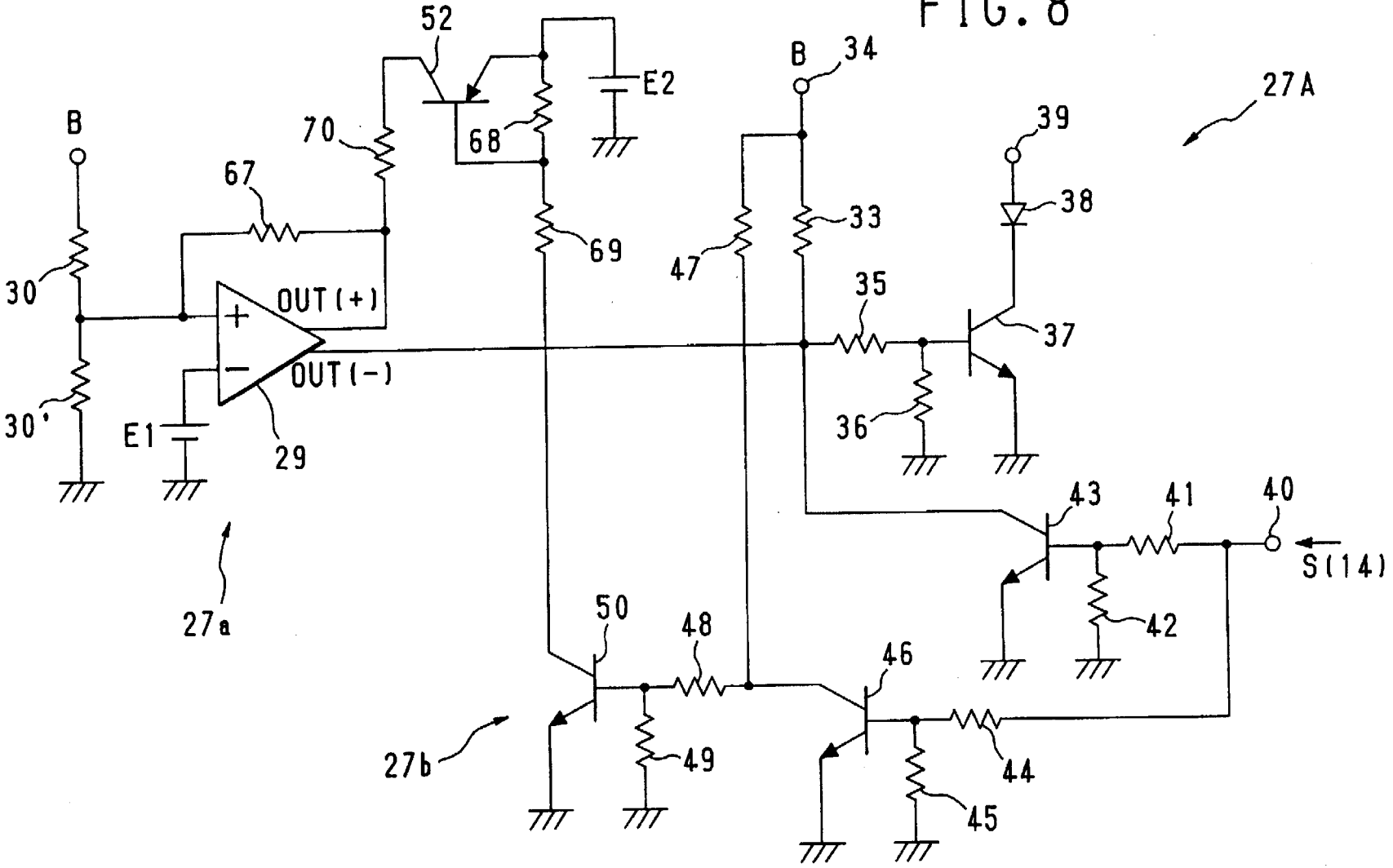

FIGS. 8 and 9 illustrate a lighting circuit according to the second embodiment. The second embodiment differs from the first embodiment in that only one of the threshold values of the input-voltage comparing section is altered, and is mostly the same as the first embodiment in other sections. To avoid the redundant description, therefore, like or same reference numbers as used for the first embodiment will be used to denote corresponding or identical components in the second embodiment.

In FIG. 8, the reference number "27A" denotes an input-voltage monitor circuit in which a resistor 67 is provided in the feedback path that connects the output terminal OUT(+) and the positive input terminal of the comparator 29 that constitutes the input-voltage comparing section 27*a*.

The emitter of the transistor 52 is connected to the constant voltage supply E2 and is connected to the collector of the transistor 50 via resistors 68 and 69. The base of the transistor 52 is connected between the resistors 68 and 69.

The collector of the transistor 52 is connected via a resistor 70 to the output terminal OUT(+) of the comparator 29.

FIG. 9 shows the hysteresis characteristic of the comparator 29, with the input voltage B taken on the horizontal scale and the binary output (H, L) of the comparator 29 plotted on the vertical scale.

Figure 9A:
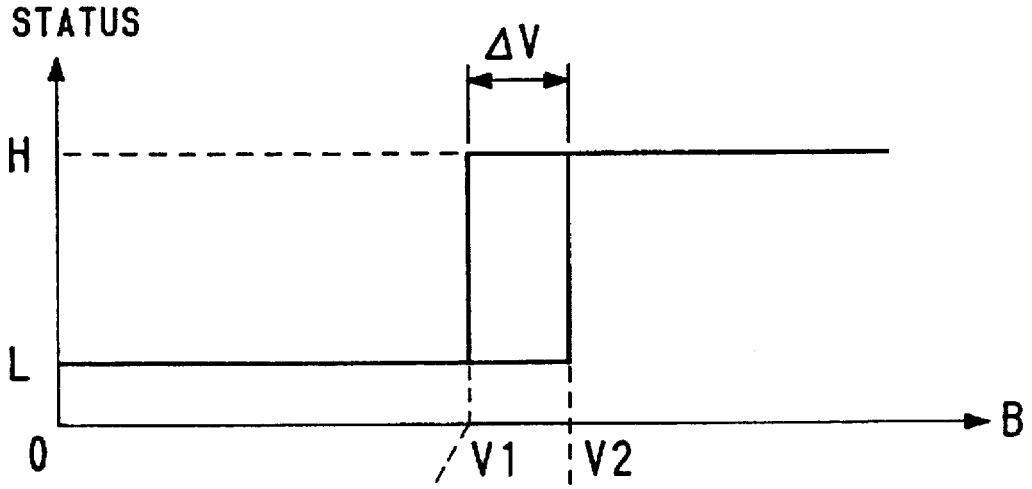
FIGS. 9A and 9B are graphs for explaining the hysteresis characteristic of a comparator.

FIG. 9A shows the comparison characteristic when the discharge lamp 10 is lighted. In this diagram, "V1" and "V2" (V1<V2) represent threshold values and ΔV" represents the voltage difference (V2−V1) between both threshold values.

The signal output from the output terminal OUT(+) of the comparator 29 goes high when the input voltage B exceeds the threshold value V2, and this signal goes low when the input voltage B falls below the threshold value V1. The output signal from the output terminal OUT(−) of the comparator 29 is the output signal from the output terminal (+) inverted logically.

Figure 9B:
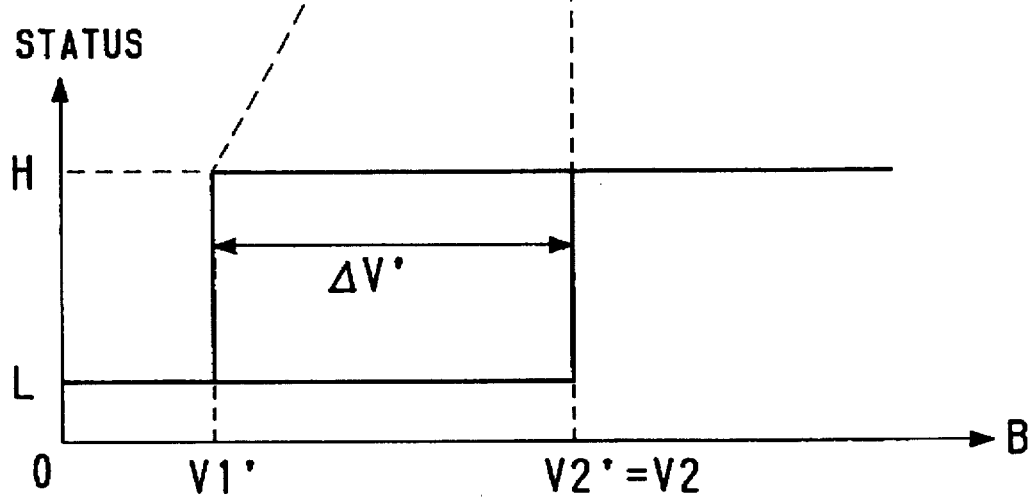
Figure 10:
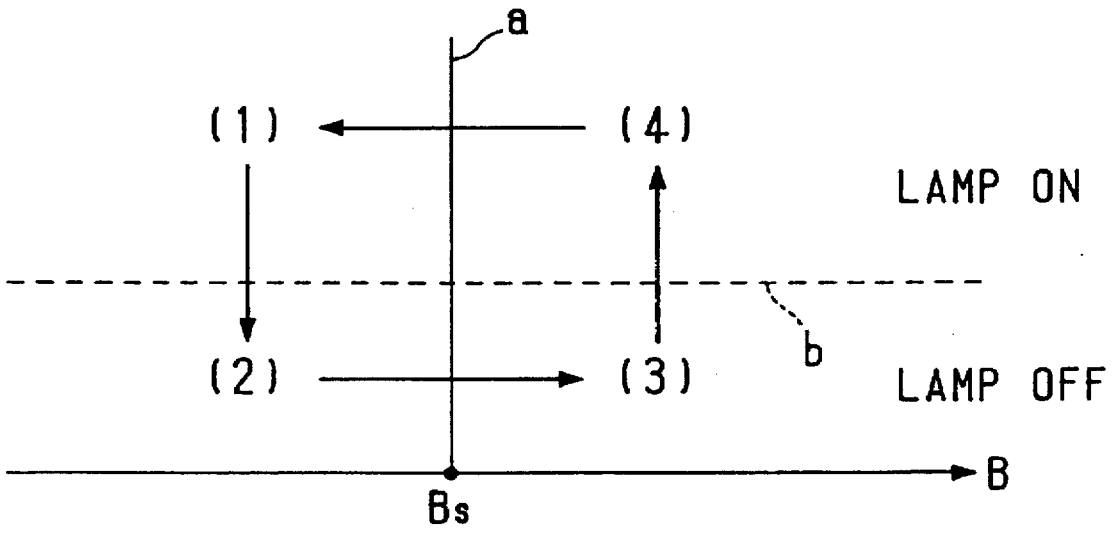
FIG. 10 is a diagram for explaining the conventional problem.

FIG. 9B shows the comparison characteristic when the discharge lamp 10 is in the OFF state. In this diagram, "V1'" and "V2'" (V1'<V2') represent threshold values and "ΔV'" represents the voltage difference (V2'−V1') between both threshold values. In this embodiment, V2'=V2 and V1'<V1.

The signal sent out from the output terminal OUT(+) of the comparator 29 goes high when the input voltage B exceeds the threshold value V2', and this signal goes low when the input voltage B falls below the threshold value V1'.

When the lighting of the discharge lamp 10 is detected by the lighting detector 14, the transistors 50 and 52 are turned off, setting the threshold values of the comparator 29 to V1 and V2 in FIG. 8. When the light-OFF state of the discharge lamp 10 is detected by the lighting detector 14, the transistors 50 and 52 are turned on, the threshold value V2 of the comparator 29 remains unchanged while the other threshold value drops to V1'. The voltage difference between both threshold values therefore changes to ΔV' from ΔV. In the case of FIG. 9B, unless the input voltage drops considerably as compared with the case of FIG. 9A, an H-level signal is not acquired from the output terminal OUT(−) of the comparator 29.

According to the second embodiment, as described above, while the maximum threshold value of the comparator 29 in the input-voltage comparing section 27*a* is fixed, the minimum threshold value is changed (from V1 to V1'). When there is a sign of the recovery of the input voltage B, therefore, the inhibition of power supply to the discharge lamp 10 is less likely to occur, thus permitting the reactivation of the discharge lamp 10 to surely take effect.

Although the allowance and inhibition of power supply to the discharge lamp 10 are controlled by the switch section 28*a* of the stable power supply circuit 28 in the above-described embodiments, the method of stopping the operation of the stable power supply circuit 28 is not limited to the inhibition of the supply voltage to this circuit 28. If the control IC has an inhibition terminal, a predetermined voltage should be applied to this terminal. Alternatively, an error signal may be intentionally input to the internal circuitry (error amplifier or the like) of the control IC. That is, any structure may be taken as long as the allowance or inhibition of power supply to the discharge lamp is determined by the output signal of the input-voltage monitor circuit 27.

In short, according to this invention, in the light-OFF state of a discharge lamp, the first threshold value and/or the second threshold value to be compared with the input voltage is set smaller than the first threshold value and/or the second threshold value in the light-ON state of the discharge lamp. When the input voltage is restored after the discharge lamp has been turned off by the dropping of the input voltage, the cutoff of power supply to the discharge lamp is unlikely to occur or power supply to the discharge lamp becomes easier. It is thus possible to turn on the discharge lamp again without requiring the reactivation of the ignition switch, and to prevent the undesirable repetition of the power supply to the discharge lamp and power cutoff in a short cycle.

Therefore, the present examples and embodiments are to be considered as illustrative and not restrictive and the invention is not be limited to the details giving herein, but may be modified within the scope of the appended claims.

What is claimed is:

1. A lighting circuit for a discharge lamp having a DC power supply section to be supplied with a voltage from a DC power supply and supplies an output voltage, based on the output voltage of said DC power supply section, to said discharge lamp, said lighting circuit comprising:

(1) lighting detection means for detecting if said discharge lamp is lighted;

(2) input-voltage monitor means for detecting an input voltage to said DC power supply section and checking if said input voltage lies within an allowable range, said input-voltage monitor means having input-voltage comparing means for detecting said input voltage to said DC power supply section and comparing said input voltage with a first threshold value or a second threshold value, and threshold changing means for changing said first or second threshold value; and (3) power-supply allowing/inhibiting means for allowing or inhibiting power supply to said discharge lamp in accordance with a signal from said input-voltage monitor means, whereby when said input voltage to said DC power supply section is less than said first threshold value at a time said input-voltage monitor means receives a signal indicative of a light-OFF state of said discharge lamp from said lighting detection means, said input-voltage monitor means sends a signal to said power-supply allowing/inhibiting means to cut off power supply to said discharge lamp and when said input voltage to said DC power supply section exceeds said second threshold value, said input-voltage monitor means sends a signal to said power-supply allowing/inhibiting means to supply power to said discharge lamp, and whereby when said signal from said lighting detection means indicates said light-OFF state of said discharge lamp, said threshold changing means sets said first threshold value in said input-voltage monitor means smaller than said first threshold value in a light-ON state of said discharge lamp and/or sets said second threshold value in said input-voltage monitor means smaller than said second threshold value in said light-ON state of said discharge lamp.

2. The lighting circuit according to claim 1, wherein when said signal from said lighting detection means indicates said light-OFF state of said discharge lamp and said input voltage to said DC power supply section exceeds said second threshold value, said threshold changing means sets said first threshold value in said input-voltage monitor means smaller than said first threshold value in a light-ON state of said discharge lamp and/or sets said second threshold value in said input-voltage monitor means smaller than said second threshold value in said light-ON state of said discharge lamp.

3. The lighting circuit according to claim 1, wherein when said signal from said lighting detection means indicates said light-OFF state of said discharge lamp and said input voltage to said DC power supply section exceeds said second threshold value, said threshold changing means sets a difference between said first and second threshold values in said input-voltage monitor means greater than a difference between said first and second threshold values in said light-ON state of said discharge lamp.

4. The lighting circuit according to claim 2, wherein when said signal from said lighting detection means indicates said light-OFF state of said discharge lamp and said input voltage to said DC power supply section exceeds said second threshold value, said threshold changing means sets a difference between said first and second threshold values in said input-voltage monitor means greater than a difference between said first and second threshold values in said light-ON state of said discharge lamp.

5. The lighting circuit according to claim 1, wherein said input-voltage comparing means is a comparator having a hysteresis characteristic and capable of providing two outputs in opposite phases, said comparator having a positive input terminal supplied with said input voltage via voltage-dividing resistor means, a negative input terminal supplied with a predetermined reference voltage, and two output terminals one of which is connected via resistor means to said positive input terminal, the other output terminal being connected to a terminal to which said input voltage is supplied; and said power-supply allowing/inhibiting means is a switch section for permitting or inhibiting power supply to said discharge lamp.

6. The lighting circuit according to claim 2, wherein said input-voltage comparing means is a comparator having a hysteresis characteristic and capable of providing two outputs in opposite phases, said comparator having a positive input terminal supplied with said input voltage via voltage-dividing resistor means, a negative input terminal supplied with a predetermined reference voltage, and two output terminals one of which is connected via resistor means to said positive input terminal, the other output terminal being connected to a terminal to which said input voltage is supplied; and said power-supply allowing/inhibiting means is a switch section for permitting or inhibiting power supply to said discharge lamp.

7. The lighting circuit according to claim 3, wherein said input-voltage comparing means is a comparator having a hysteresis characteristic and capable of providing two outputs in opposite phases, said comparator having a positive input terminal supplied with said input voltage via voltage-dividing resistor means, a negative input terminal supplied with a predetermined reference voltage, and two output terminals one of which is connected via resistor means to said positive input terminal, the other output terminal being connected to a terminal to which said input voltage is supplied; and said power-supply allowing/inhibiting means is a switch section for permitting or inhibiting power supply to said discharge lamp.

8. The lighting circuit according to claim 4, wherein said input-voltage comparing means is a comparator having a hysteresis characteristic and capable of providing two outputs in opposite phases, said comparator having a positive input terminal supplied with said input voltage via voltage-dividing resistor means, a negative input terminal supplied with a predetermined reference voltage, and two output terminals one of which is connected via resistor means to said positive input terminal, the other output terminal being connected to a terminal to which said input voltage is supplied; and said power-supply allowing/inhibiting means is a switch section for permitting or inhibiting power supply to said discharge lamp.

9. The lighting circuit according to claim 1, wherein said lighting detection means detects if said discharge lamp is lighted by monitoring a signal equivalent to a lamp voltage or a lamp current of said discharge lamp.

10. The lighting circuit according to claim 2, wherein said lighting detection means detects if said discharge lamp is lighted by monitoring a signal equivalent to a lamp voltage or a lamp current of said discharge lamp.

11. The lighting circuit according to claim 3, wherein said lighting detection means detects if said discharge lamp is lighted by monitoring a signal equivalent to a lamp voltage or a lamp current of said discharge lamp.

12. The lighting circuit according to claim 4, wherein said lighting detection means detects if said discharge lamp is lighted by monitoring a signal equivalent to a lamp voltage or a lamp current of said discharge lamp.

13. The lighting circuit according to claim 9, wherein said lighting detection means includes voltage detection means for detecting an output voltage of said DC power supply section, which is equivalent to said lamp voltage of said discharge lamp, and outputting a detection signal corresponding to said detected output voltage of said DC power supply section, whereby said lighting detection means detects if said discharge lamp is lighted based on said detection signal from said voltage detection means.

14. The lighting circuit according to claim 10, wherein said lighting detection means includes voltage detection means for detecting an output voltage of said DC power supply section, which is equivalent to said lamp voltage of said discharge lamp, and outputting a detection signal corresponding to said detected output voltage of said DC power supply section, whereby said lighting detection means detects if said discharge lamp is lighted based on said detection signal from said voltage detection means.

15. The lighting circuit according to claim 11, wherein said lighting detection means includes voltage detection means for detecting an output voltage of said DC power supply section, which is equivalent to said lamp voltage of said discharge lamp, and outputting a detection signal corresponding to said detected output voltage of said DC power supply section, whereby said lighting detection means detects if said discharge lamp is lighted based on said detection signal from said voltage detection means.

16. The lighting circuit according to claim 12, wherein said lighting detection means includes voltage detection means for detecting an output voltage of said DC power supply section, which is equivalent to said lamp voltage of said discharge lamp, and outputting a detection signal corresponding to said detected output voltage of said DC power supply section, whereby said lighting detection means detects if said discharge lamp is lighted based on said detection signal from said voltage detection means.

17. The lighting circuit according to claim 9, wherein said lighting detection means includes current detection means for detecting an output current of said DC power supply section, which is equivalent to said lamp current of said discharge lamp, and outputting a detection signal corresponding to said detected output current of said DC power supply section, whereby said lighting detection means detects if said discharge lamp is lighted based on said detection signal from said current detection means.

18. The lighting circuit according to claim 10, wherein said lighting detection means includes current detection means for detecting an output current of said DC power supply section, which is equivalent to said lamp current of said discharge lamp, and outputting a detection signal corresponding to said detected output current of said DC power supply section, whereby said lighting detection means detects if said discharge lamp is lighted based on said detection signal from said current detection means.

19. The lighting circuit according to claim 11, wherein said lighting detection means includes current detection means for detecting an output current of said DC power supply section, which is equivalent to said lamp current of said discharge lamp, and outputting a detection signal corresponding to said detected output current of said DC power supply section, whereby said lighting detection means detects if said discharge lamp is lighted based on said detection signal from said current detection means.

20. The lighting circuit according to claim 12, wherein said lighting detection means includes current detection means for detecting an output current of said DC power supply section, which is equivalent to said lamp current of said discharge lamp, and outputting a detection signal corresponding to said detected output current of said DC power supply section, whereby said lighting detection means detects if said discharge lamp is lighted based on said detection signal from said current detection means.

* * * * *